US008872111B2

(12) United States Patent
Burkland

(10) Patent No.: US 8,872,111 B2
(45) Date of Patent: Oct. 28, 2014

(54) INFRARED SPATIAL MODULATOR FOR SCENE-BASED NON-UNIFORMITY IMAGE CORRECTION AND SYSTEMS AND METHODS RELATED THERETO

(75) Inventor: Michael K. Burkland, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 249 days.

(21) Appl. No.: 13/020,941

(22) Filed: Feb. 4, 2011

(65) Prior Publication Data

US 2012/0199689 A1 Aug. 9, 2012

(51) Int. Cl.
*G01J 5/00* (2006.01)
*F42B 15/01* (2006.01)

(52) U.S. Cl.
CPC ..... *F42B 15/01* (2013.01)
USPC ..... 250/338.1

(58) Field of Classification Search
CPC ..... G01J 1/0295; G01M 11/00; H04N 5/3658
USPC ..... 250/338.1, 332; 244/3.16
See application file for complete search history.

(56) References Cited

U.S. PATENT DOCUMENTS 4,283,113 A 8/1981 Eden
4,698,687 A 10/1987 Levin
5,012,274 A 4/1991 Dolgoff
5,089,904 A * 2/1992 Fergason ..... 349/94
5,264,951 A 11/1993 Takanashi
5,300,942 A 4/1994 Dolgoff
5,323,002 A * 6/1994 Sampsell et al. ..... 250/252.1
5,608,568 A 3/1997 Blodgett et al.
5,841,579 A 11/1998 Bloom et al.
6,339,219 B1 1/2002 Ishizuya et al.
7,035,475 B1 * 4/2006 Chen et al. ..... 382/254
7,795,578 B2 9/2010 Hogesten et al.

OTHER PUBLICATIONS

Ewing, Theresa, et al., "Liquid crystal on silicon infrared scene projectors (Proceedings Paper)", Proceedings vol. 5785, Technologies for Synthetic Environments: Hardware-in-the-Loop Testing X, Robert Lee Murrer, Jr., Editors, (May 20, 2005), 10 pgs.
Fontecchio, Adam, et al., "Tunable thin film wavelength filters for hyperspectral imaging", [Online] http://nanophotonics.ece.drexel.edu, (Oct. 17, 2010), 22 pgs.
Forber, R A, et al., "Dynamic IR scene projection using the Hughes liquid crystal light valve (Proceedings Paper)", Proceedings of SPIE 1665, [Online] Downloaded from SPIE Digital Library on Sep. 1, 2010 to 199.46.245.230, (1992), 259-73.

(Continued)

*Primary Examiner* — David Porta
*Assistant Examiner* — Edwin Gunberg
(74) *Attorney, Agent, or Firm* — Schwegman, Lundberg & Woessner, P.A.

(57) ABSTRACT

Embodiments of an infrared spectral modulator for scene-based non-uniformity image correction are generally disclosed herein. The spectral modulator may be suitable for use in a system for navigating an object having a flight path comprising an infrared sensor having an optical path; an infrared modulator in the optical path of the infrared sensor, wherein the infrared modulator is configured to allow the infrared sensor to perform in situ, real-time, scene-based non-uniformity correction; and a guidance system within the object, wherein the guidance system can adjust the flight path of the object based on the non-uniformity correction.

26 Claims, 14 Drawing Sheets

(56) References Cited

OTHER PUBLICATIONS

Geng, Jun, et al., "Electrically addressed and thermally erased cholesteric cells", Appl. Phys. Lett. 89 [Online] Downloaded Sep. 23, 2010 to 199.46.245.237, (2006), 3 pgs.
Gentle, Angus R, et al., "Optical and electrical switching in nanostructured coatings of VO2", Proc. of SPIE vol. 6647 664709-1 [Online] Downloaded from SPIE Digital Library on May 10, 2010 to 199.46.245.231, (2007), 8 pgs.
Hattori, Reiji, "Power consumption of a quick-response liquid powder display (QR-LPD)", IMID '05 Digest, (2005), 845-49.
Joo, Joo Jin, et al., "Characteristics of ZnO thin films modified by various additives", Proc. of SPIE vol. 7217 72170W-1 [Online] Downloaded from SPIE Digital Library on May 10, 2010 to 199.46.245.231, (2009), 9 pgs.
Kaid, M A, "Characterization of Electrochromic Vanadium Pentoxide Thin Films Prepared By Spray Pyrolysis", Egypt. Solids, 29(2) [Online] Downloaded from SPIE Digital Library on May 10, 2010 to 199.46.245.231, (2006), 273-91.
Kammler, Daniel, et al., "Use of electrochromic materials in adaptive optics (Proceedings Paper)", Proc. of SPIE 58950S-1 [Online] Downloaded from SPIE Digital Library on Apr. 28, 2010 to 199.46.245.231, (Aug. 23, 2005), 9 pgs.
Lippert, Jack, et al., "Record breaking high-apparent temperature capability of LCoS-based infrared scene projectors", Proc. of SPIE vol. 7663 76630S-7 [Online] Downloaded from SPIE Digital Library on May 10, 2010 to 199.46.245.231, (2010), 7 pgs.
Luo, Yangling, et al., "Spatial light modulator based on sheared polymer network liquid crystal (Proceedings Paper)", Proc. of SPIE vol. 6835 68350C-3 [Online} Downloaded from SPIE Digital Library on May 10, 2010 to 199.46.245.231, (Jan. 8, 2008), 7 pgs.
Ma, Chao, et al., "Smart sunglasses with tuneable shade (Proceedings Paper)", Proc. of SPIE vol. 6927 69271J-1 [Online] , Downloaded from SPIE Digital Library on May 10, 2010 to 199.46.245.231, (2008), 8 pgs.
O'Brien, D C, et al., "Real time holograms using ferroelectric liquid crystal spatial light modulators", [Online] In IEE Colloquium on Two-Dimensional Optoelectronic Device Arrays, INSPEC Accession No. 4068353; Downloaded on May 25, 2010 at 01:26:47 UTC from IEEE Xplore, Meeting Date: Oct. 21, 1991 Location: London , UK, (Oct. 21, 1991), 1011-1014.
Paradis, S, et al., "Vanadium oxide films for optical modulation applications (Proceedings Paper)", Proc. of SPIE vol. 6343 63433U-1 [Online] Downloaded from SPIE Digital Library on May 10, 2010 to 199.46.245.231, (2006), 7 pgs.
Stockley, Jay, et al., "Liquid crystal on silicon spatial light modulator for infrared scene generation (Proceedings Paper)", Proc. of SPIE vol. 7301 73010H-1 [Online] Downloaded from SPIE Digital Library on May 10, 2010 to 199.46.245.231, (Apr. 22, 2009), 11 pgs.
Subramani, D, "Chapter 5: Spatial Light Modulator system", In The Diode Laser Source and the Spatial Light Modulator's Driver Electronics for Miniaturized Holographic 3D Imaging, Master's Thesis, (Date of Defense: Dec. 17, 1998), 26 pgs.
Takahashi, N S, et al., "Photo-addressed spatial light modulators using high frequency-driven ferroelectric liquid crystal and amorphous silicon photosensor", Solar Energy Materials and Solar Cells, 92(11), (Nov. 2008), 1483-1487.
Vergaz, Ricardo, et al., "Modeling and electro-optical testing of suspended partical devices", Solar Energy Materials and Solar Cells, 92(11), (Nov. 2008), 1483-1487.
Wang, Haifang, et al., "Study on infrared optical switching of vanadium dioxide thin film (Proceedings Paper)", Proc. of SPIE vol. 7509 75090P-1 [Online] Downloaded from SPIE Digital Library on May 10, 2010 to 199.46.245.231, (2009).
Wu, Shin-Tson, et al., "Laterally fluorinated liquid crystals for display applications (Proceedings Paper)", SPIE vol. 3015 [Online] Downloaded from SPIE Digital Library on May 10, 2010 to 199.46.245.231, (1997), 6 pgs.
Xu, Ming, et al., "Dual frequency cholesteric light shutters", Appl. Phys. Lett. 70(6), (Feb. 10, 1997), 720=22.
""Interferometry" (from Wikipedia)", [online], Downloaded at http://en.wikipedia.org/wiki/Interferometry, (Downloaded on Feb. 1, 2011).
Avendano, E, et al., "Electrochromic materials and devices: Brief survey and new data on optical absorption in tungsten oxide and nickel oxide films", Thin Solid Films, 496, (2006), 30-36.
Averbuch, Amir, et al., "Scene based non-uniformity correction in thermal images using Kalman filter", Image and Vision Computing, 25(6), (Jun. 1, 2007), 833-851.
Barbier, R, et al., "Spatial Light Modulators: Processing Light in Real Time", Optics and Photonics News, 8(3), (Mar. 1997), 16-21.
Blodgett, David, et al., "Improved vanadium-dioxide-based infrared spatial light modulator (Proceedings Paper)", SPIE vol. 2223 / 63 [Online] Downloaded from SPIE Digital Library on May 10, 2010 to 199.46.245.231, (Jun. 15, 1994), 12 pgs.
Chain, Elizabeth E, "Optical properties of vanadium dioxide and vanadium pentoxide thin films", Applied Optics, 30(19), (1991), 2782-2787.
Chen, Xiqu, et al., "Optical switch based on nanocrystalline VOx thin film (Proceedings Paper)", Optoelectronic Materials and Devices IV, Proceedings, vol. 7631 [Online] Downloaded from SPIE Digital Library on May 10, 2010 to 199.46.245.231, (Dec. 1, 2009), 7 pgs.
Efron, U., et al., "The silicon liquid-crystal light valve", J. Appl. Phys., 57(4), (Feb. 15, 1984), 1356-1368.
Luo, Yangling, et al., "Spatial light modulator based on sheared polymer network liquid crystal (Proceedings Paper)", Proc. of SPIE vol. 6835 68350C-3 [Online] Downloaded from SPIE Digital Library on May 10, 2010 to 199.46.245.231, (Jan. 8, 2008), 7 pgs.
O'Brien, D C, et al., "Real time holograms using ferroelectric liquid crystal spatial light modulators", In IEE Colloquium on Two-Dimensional Optoelectronic Device Arrays, INSPEC Accession No. 4068353 [Online] Downloaded on May 25, 2010 at 01:26:47 UTC from IEEE Xplore, Meeting Date: Oct. 21, 1991, Location: London , UK, (Oct. 21, 1991), 1011-1014.
Xu, Ming, et al., "Dual frequency cholesteric light shutters", Appl. Phys. Lett. 70(6), (Feb. 10, 1997), 720-22.

* cited by examiner

INFRARED SPATIAL MODULATOR FOR SCENE-BASED NON-UNIFORMITY IMAGE CORRECTION AND SYSTEMS AND METHODS RELATED THERETO

BACKGROUND

Modern warfare is based on the projection of lethal ordinance, with high precision that minimizes collateral damage. Various types of imaging systems are used to guide a projectile to its intended target. A passive infrared (IR) seeker detects the thermal signatures of targets, providing video used by the guidance system to track and impact the intended targets. Thermal IR radiation is emitted by all objects in a portion of the electromagnetic spectrum at frequencies less than that of visible light. Therefore, such IR guidance systems are also referred to as heat seeking guidance systems. Projectiles or missiles using such systems are often referred to as "heat-seekers."

Heat-seekers typically contain IR thermal array sensors (i.e., detectors) which are sensitive to radiation in the IR band. Non-uniformities in the responsitivity of such sensors result in different outputs from picture elements (pixels) in the array in spite of receiving similar input information, which appear as non-uniformities in the video image. Such non-uniformities interfere with proper operation of the guidance system and need to be corrected.

SUMMARY

The inventor is the first to recognize the need for an improved guidance system capable of enabling real-time, in situ, non-mechanical, scene-based non-uniformity correction (NUC) in IR thermal array sensors (hereinafter "IR sensor"). Accordingly, in one embodiment, a system for navigating an object having a flight path comprising: an IR sensor having an optical path (i.e., the path light takes in traversing an optical system); a NUC IR spatial modulator (hereinafter "IR modulator") in the optical path of the IR sensor, wherein the IR modulator is configured to allow the IR sensor to perform in situ, scene-based NUC; and a guidance system within the object, wherein the guidance system can adjust the flight path of the object based on the NUC provided. The IR modulator is capable of clearly transmitting and scattering variable intensities of IR radiation from a target imaged to the focal plane array (FPA) of a thermal IR sensor. By activating and deactivating the IR modulator in this manner, the scene-based NUC can be performed rapidly, i.e., in less than one second. In one embodiment, the IR modulator is made from a smart glass, such as a liquid crystal or suspended particle device, such as an electrochromic device.

In one embodiment, a method of navigating an object comprising with an onboard infrared modulator, applying a non-uniform correction to an infrared sensor, the non-uniform correction comprising obtaining a first video image of a first translucent scattered image of a scene having a target equivalent temperature, the scene containing a target blackbody object, a first equivalent blackbody object, and a second equivalent blackbody object, wherein the first equivalent blackbody object has a first intensity associated with a first equivalent temperature; processing the first video image in the infrared sensor, wherein the infrared sensor provides a first intensity signal to a calculating device; obtaining a second video image of a second translucent scattered image of the scene, wherein the second equivalent blackbody object has a second intensity associated with a second equivalent temperature; processing the second video image in the infrared sensor, wherein the infrared sensor provides a second intensity signal to the calculating device; calculating non-uniform correction terms from information in the first and second intensity signals; with the infrared modulator operating in a transparent state, obtaining a third video image of the target blackbody object, the target blackbody object having a target blackbody intensity associated with the target equivalent temperature; processing the third video image in the infrared sensor, wherein the infrared sensor provides a scene intensity signal to the calculating device; and performing signal processing using the scene intensity signal and the non-uniform correction terms to produce a spatially corrected uniform image is provided.

As is explained in further detail herein, in addition to information in the first and second intensity signals, information on the relative difference of intensity levels of transmission states, using pre-calibration information is also used to calculate the non-uniform correction terms. This information, i.e., a calibrated transmissions difference, is applied to the data received in-situ to provide $\Delta T$ information used in the non-uniformity correction calculation.

The first and second translucent scattered images are from energy (photons) from the whole (entire) scene, not just a single blackbody object within the scene. Thus, the target equivalent temperature can be considered the "average temperature" of all the objects in the scene. (As is described herein, the first and second equivalent temperatures are associated with first and second equivalent blackbody radiances, respectively, emitted from the first and second equivalent blackbody objects, respectively).

The novel IR modulators described herein may be useful in a variety of applications, other than military, such as civilian or medical applications. Other features and advantages will become apparent from the following description of the embodiments, which description should be taken in conjunction with the accompanying drawings.

DETAILED DESCRIPTION

Figure 1:
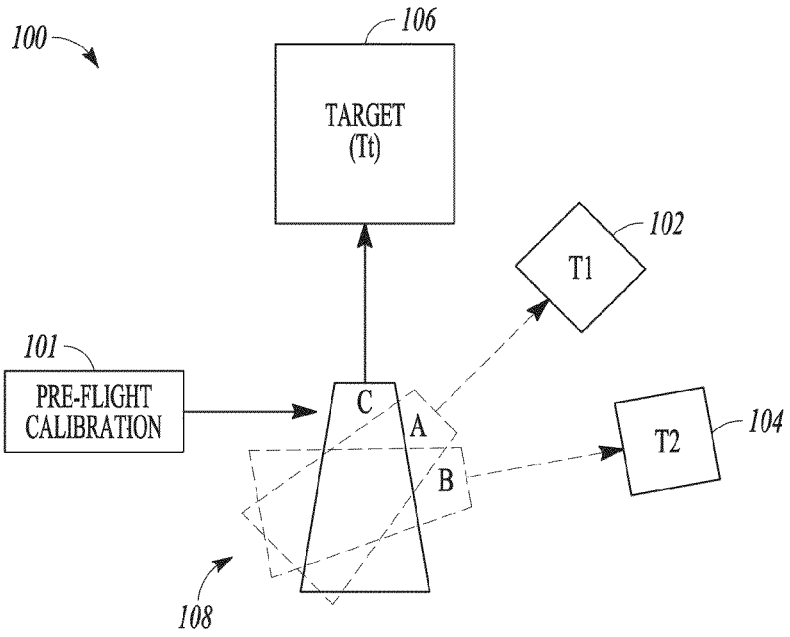
FIG. 1 (PRIOR ART)
FIG. 1 is a simplified schematic of a prior art method of collecting video images before flight to calculate gain and offset terms for a two point non-uniformity correction (NUC) for use of normalizing subsequent imaging of detecting a thermal target.

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

The process of determining NUC gain and offset terms during a flight path is referred as Adaptive NUC (ADNUC). The novel system described herein allows for real-time, scene-based NUC, through utilization of an IR modulator in the optical path of an imaging IR focal plane array (FPA), which is capable of modifying the thermal image of a target by diffusely scattering the wave front, thus providing uniform illumination across the FPA. In one embodiment, at least two different levels of intensity are displayed by varying the degree of scattering projected upon the IR FPA, after which the IR modulator is activated, allowing a transition to clear transmission for unobstructed imaging by the IR FPA.

As used herein, projectile refers to missiles, interceptors, guided projectiles (i.e., seekers, which can include directional pointing via gimbal assemblies), bombs and sub-munitions. Technically, a blackbody or blackbody source refers to an idealized physical body that absorbs and transmits all incident electromagnetic radiation at a rate associated with the temperature of the blackbody. However, as used herein, the term "blackbody" or "blackbody source" may refer to any type of target (building, tank, people, etc.) which ideally absorbs and emits electromagnetic radiation of varying intensities that can be measured in the IR spectrum. In practice, most objects outside of the laboratory do not emit and absorb radiation at an equivalent rate; these objects are referred to as gray bodies. Targets for IR seekers are gray bodies, but are, for practical purposes, treated and referred to as blackbody sources. These blackbodies or blackbody sources reside in a larger environment, also emitting IR radiation, imaged in the field of view of the projectile. It is the collective irradiance of the scene in the field of view that is attenuated by scattering with the IR modulator providing a uniform image. The intensity of this scattered image is proportional to the intensity of the collective scene in the field of view and to which can be ascribed an "effective" temperature of the scene.

Several types of detection equipment are used to detect infrared light. A micro-bolometer, for example, is used as a thermal detector when assembled in an array comprising a focal plane array (FPA) for imaging the intensity of incident infrared (IR) electromagnetic radiation. Detector material in the micro-bolometer is subject to temperature changes. As the material is illuminated by the focused image, it becomes warmer or colder depending on the temperature of the object being imaged in contrast to the ambient temperature of the detector material. The temperature change, in turn, causes the electrical resistance of the micro-bolometer to change. The resistance change is measured for each pixel and collectively processed into images, which can be interpreted as temperature values based on prior calibration of the response of the device.

Non-uniformity correction (NUC) of video is performed by scaling and offsetting the detected signal for each pixel based on gain and offset terms calculated from video imagery of a uniform target scene. The gain and offset terms calculated are dependent upon the intensity of the uniform scene being imaged; for an IR imaging system, the intensity of the scene is related to the temperature of the scene as a radiating black body. The effectiveness of NUC gain and offset terms is to correct the spatial non-uniformity of a video image, known as Fixed Pattern Noise (FPN). The FPN is a measure of the spatial variation of the response of the pixels across the FPA as referenced for a uniform level of irradiance.

A non-uniformity correction (NUC) is typically performed to decrease the non-uniformity (i.e., FPN) of the IR FPA, which is an inherent characteristic due to different response rates among pixels having the same IR radiance and the relative offset of initial detection levels. Applying NUC gain and offset terms increases sensitivity of the detector and increases the spatial and thermal resolution of the imaging system. Additionally, as a result of thermal equilibration over time with the surrounding environment, the thermal state of the detector material changes accordingly, resulting in a degradation of quality of previously applied NUC terms. This leads to an increase in FPN and a loss in sensitivity and resolution.

The variation in the rate of change in response from pixel to pixel over temperature is corrected by applying the appropriate multiplier terms to each pixel that results in a uniform response, referred to as gain compensation. Offset terms are applied to bring all pixels to the same response level for a given uniform irradiance over the FPA. As the thermal environment of the FPA and/or scene change new offset and gain terms need to be calculated, i.e., a "re-NUC". The effectiveness of applying NUC to IR video is dependent on the portion of the dynamic range of the FPA thermal response in which the scene temperatures for calibration were acquired. Video from uniform image scenes at different black body temperatures bound the range of temperatures of blackbodies expected to be imaged. The sensitivity of the detector to resolve temperature differences between objects is the noise equivalent change in temperature (NEAT) defined as the level of temperature difference (signal) that can be detected for a signal-to-noise ratio (SNR) of one. Reducing the FPN of the imaged video improves the sensitivity of the imaging system, as measured by NEAT.

The FPN can also occur when a response is inconsistent within the calibrated range due to changes in position of various components in communication with the detector, such as optics, mechanics and electronics, or because of a physical change in the structure of the detecting material within the array. Such changes can occur during launch, as projectiles can experience launch shock events up to 10 KG deforming the structure of the detector elements thus changing the response. Therefore, FPN can affect the sensitivity metrics of the IR FPA by many means.

Non-uniformity can be corrected in two degrees of fidelity. The first degree is a one-point, or single-point NUC which involves normalizing the level of response of the array by offsetting each pixel by an appropriate amount. These offset terms are calculated based on illuminating the FPA with a scene of uniform intensity. The level of intensity of the scene is dependent on the temperature of the blackbody source projecting the IR radiation, and must be within the dynamic range of the detector. The dynamic range being the range between the lowest temperature blackbody detectable and the highest temperature blackbody filling the capacity of FPA to detect the object. The second degree of fidelity to compensating Non-uniformity of a FPA is by modifying the different response rates over temperature of individual pixels by applying calculated gain terms. Gain correction terms are calculated based on the response images of two uniform scenes of illumination of known blackbody temperatures. From a two-point NUC, both gain and offset terms are derivable from the same set of calibration data. Both means of determining gain and offset NUC terms are routinely derived in a laboratory or factory setting.

Previous attempts to provide NUC in flight include a one-point correction method in which a mechanical shutter or "spade" is placed in front of an IR FPA. However, accuracy is quite limited with a one-point NUC as only one source of known intensity is being imaged which may or may not be within the thermal dynamic range of the scene to be imaged.

Another attempt to provide NUC in flight includes rapid motion of the projectile through a field of regard that produces a blurred (or approximately uniform) image of the scene.

In contrast, an in flight two-point NUC sequentially requires imaging two uniform sources of known intensity. One known two-point NUC method involves use of a variable thermal source which requires a secondary mirror as a thermal flood source, such that two different thermal target of known temperatures need to be mechanically positioned for imaging by the FPA using secondary mirror.

Other two-point correction systems are mechanically-based systems and rely on reference-based correction using calibrated images on startup.

Other in flight one and two-point NUC methods involve various software algorithms based on data from one or a series of scene images that may involve averaging schemes, or software based filter modification of the image(s) to simulated a uniform scene.

Essentially, many of the differences between the responses and signal levels of an IR FPA are removed through calibration during production of a sensor by measuring the signal at two or more known temperatures and correcting the response (gain) and signal level (offset) for all the detector elements. FIG. 1 shows one example of a mechanically-based prior art "two-point" non-uniformity correction (NUC) method 100 which involves the use of pre-flight calibration 101 in a laboratory or factory environment (i.e., a reference-based system) to correct for FPN. The method 100 requires imaging two external blackbody sources 102 and 104 of different intensities and, therefore, different temperatures, T1 and T2, respectively. As FIG. 1 shows, obtaining this intensity information requires elements of an IR heat-seeker 108 to physically move from position "A" to position "B" in order to place the blackbody sources 102 and 104, respectively, in front of the IR heat-seeker 108. The IR heat-seeker 108 is then moved to position "C" such that it is aligned with a target 106 having an effective target temperature, Tt. With this data, a pre-flight mechanically-based NUC can be stored electronically in memory (not shown) located on the IR heat-seeker 108 to reduce a FPN of the imaged scene. As noted above, calibrations performed by reference-based systems are only sufficient for scene temperatures that are valid in the dynamic range for which the calibration was performed Additionally, given the harsh environment a projectile experiences in flight, in combination with the limited time available to perform NUC in flight, i.e., on the order of hundreds of milliseconds, reliance on a real-time reference-based system can compromise remaining mission timeline required for subsequent seeker tasks vital for striking the desired target 106.

Other known two-point methods are considered to be "scene-based" in that they are capable of continually recalibrating the sensor for parameter drifts. A scene based NUC refers to uniformity terms calculated from the intensity of video images bounding the temperature of expected targeted scenes. However, such methods rely on software to provide one or more algorithms to calculate the NUC. These methods are complex and, once the algorithm is entered, the system is unable to provide a rapid response rate to any real-time issues that may arise. (See, for example, John G. Harris, et al., *Nonuniformity Correction of Infrared Image Sequences Using the Constant-Statistics Constraint*, IEEE Transactions on Image Processing, Vol. 8, No. 8, August 1999). Other software methods are designed to perform NUC in a variety of ways, such as by applying a filter.

Figure 2:
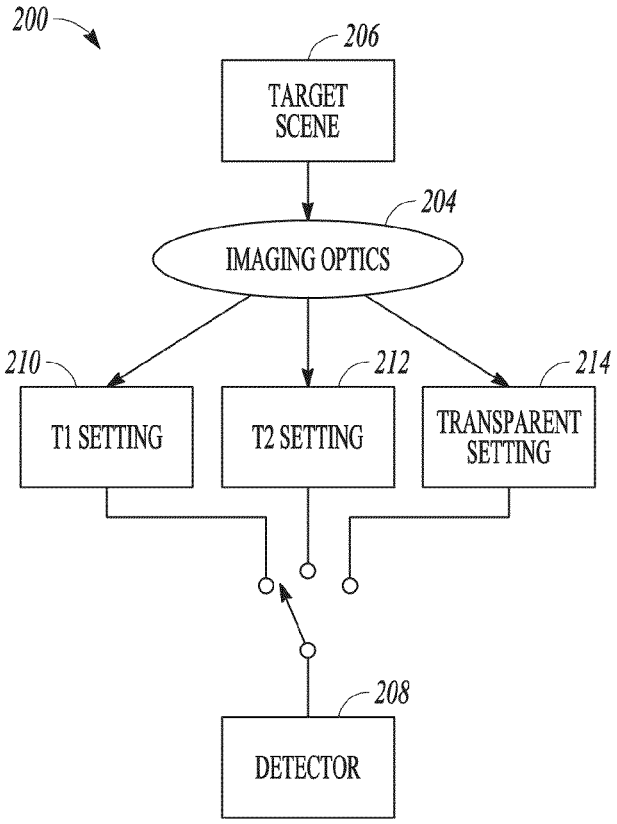
FIG. 2 is a simplified schematic of a novel method of acquiring data for a scene based NUC in real time and detecting a thermal target in accordance with an illustrative embodiment of the present invention.

In contrast, the novel embodiments described herein provide an in situ, real-time, scene-based two-point correction system which is not mechanically-based, and, although utilizing pre-flight calibration data on the relative difference of intensity levels of transmission states, does not rely on conventional pre-loaded signal processing algorithms. As shown in FIG. 2, the novel "two-point" scene-based NUC method 200 involves use of a detector 208 which can be located on an IR heat-seeker (not shown). Imaging optics 204 are used to view a target scene 206. In this embodiment, the image projected onto the detector 208 in the FPA is sequentially scattered and attenuated 208 attenuates at two different levels to obtain a T1 210 and a T2 212 measurement, which are both proportional to and associated with temperature of the illuminating target scene 206. Thereafter, a transparent setting 214 is detected and an ADNUC is applied to the image 208. In one embodiment, the detector is an LWIR sensor, such as an un-cooled LWIR sensor for tactical missile products, such as a heat seeker.

Equivalent temperature can be determined as follows:

$$T = \text{Responsitivity} \times \text{Transmission} \times \left[ \frac{\sum_{FOV} TargetScene}{N_{pixels}} \right]$$

in which "Responsivity" is the responsivity of the detector 208, which relates the temperature to signal levels. (This responsivity pertains to the response signals of a known difference in blackbody temperatures and is calibrated prior to the use of the projectile). "Transmission" is the level of attenuation that the signal is reduced by, with the term in brackets representing the uniformity/scattering processes that take place. Scene uniformity, expressed in the last term, is where energy of the target scene 206 in the Field of View (FOV) is summed from and normalized to the number of pixels in the array so that each pixel sees the same energy, i.e., a substantially uniform image.

In one embodiment, ADNUC is accomplished through a polarization neutral transmission of IR radiation, such as long wave IR (LWIR) radiation with an IR modulator containing smart glass, such as a liquid crystal (LC) using a pair of cholesteric right and left handed LC molecules (CLC) as described herein. As a result, accuracy is improved over conventional methods, including methods using simulated preflight temperatures for target temperature outside the calibration temperature range (FIG. 1).

As used herein the term "smart glass" refers to any type of material in which optical properties can be dynamically change electronically without any mechanical means. A smart glass can be thermochromic (optical properties altered by temperature), electrochromic (electroactive materials that present a reversible change in optical properties when electrochemically oxidized or reduced) or both. Smart glass may be formed into a film of any desired thickness, which is then either applied to another component or may be a separate element and placed in front of another component. The LC smart glass can be any suitable thickness, d, which can be calculated by, $$d = \frac{\lambda}{4\Delta n}$$

In one embodiment, the thickness is between about 10 and 30 microns. However, if the smart glass is too thick, however, the quality of the temporal and/or spatial response of the device can be compromised.

In one embodiment, at least two different scenes of effective temperatures, T1 and T2, at two different locations within the blackbody are detected. In one embodiment, the operating temperatures, i.e., the "effective" temperature of the scene, range from about 0° C. to 50° C. In this embodiment, NUC is performed at effective temperatures of 20° C. and 30° C., such that calibration is provided over the entire range of 0° to 50° C. In one embodiment, the temperature difference is about 10° C.

Figure 3:
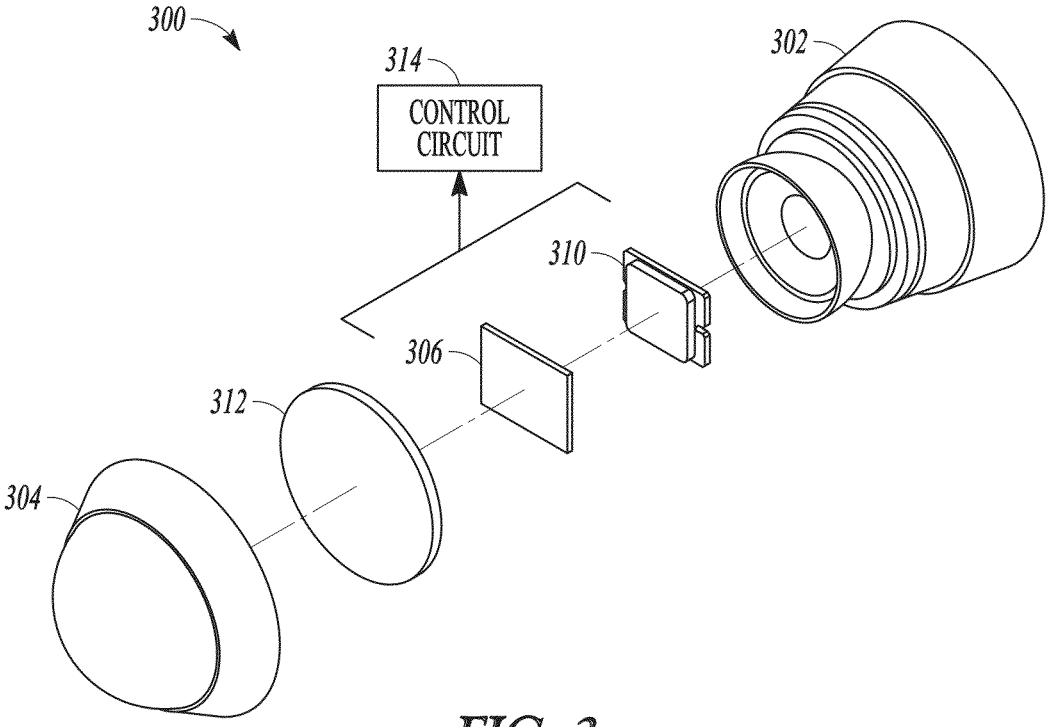
FIG. 3 is an exploded view of an example projectile containing a non-uniformity correction (NUC) spatial IR modulator (hereinafter "IR modulator") in accordance with an illustrative embodiment of the present invention.

FIG. 3 shows an exemplary projectile 300 having a housing 302 which terminates on a front end with a dome 304. The projectile further contains a non-uniformity correction (NUC) IR modulator ("IR modulator") 306 located between a fixed plane array (FPA) (or IR sensor) 310 and an optical element 312, such as an IR lens or a reflecting telescope. The IR modulator 306 and FPA are in communication with a control circuit 314 described in more detail in FIG. 15. The IR modulator 306 is capable of diffusely scattering IR waves having variable intensities, in turn, imaged by the FPA. In one embodiment, the IR is in the long wave portion of the spectrum. In one embodiment, the IR waves are mid wave IR (MWIR). Although the IR waves can also be short wave IR (SWIR), only a one-point NUC measurement typically required in this instance since the detected IR radiation in the short wave band is reflective and not radiant, and not subject to thermal equilibrium processes.

In one embodiment, a system is provided which is capable of producing at least two diffuse images that can be associated with effective temperatures such that a NUC can be calculated. For a single scattering state, i.e., a "one-point" NUC, the offset terms for the Focal Plane Array (FPA) can be calculated. For two scattering states, i.e., a "two-point" NUC, both the pixel offset and pixel gain factors can be calculated. In one embodiment, the final state of the IR modulator can allow for "fully" transparent transmission (i.e., maximum transparency possible such that the response of LC alignment to the applied electric field is fully achieved) of the thermal target to the FPA providing high quality imagery for sensor functions. (See also FIGS. 5A-5C). In one embodiment, a "partially" transparent state may be reached at voltages less than about 20 volts (V). (See also FIG. 12).

Figure 4:
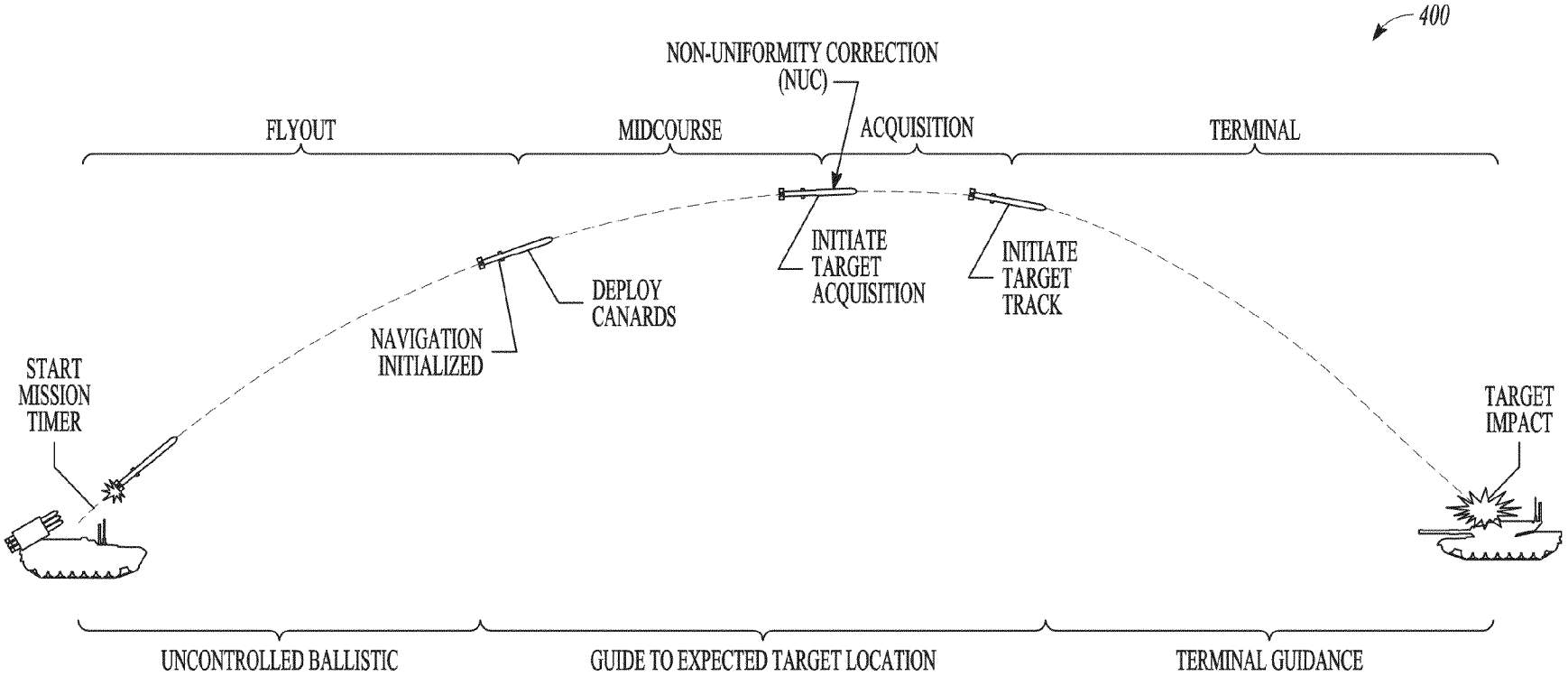
FIG. 4 is a simplified schematic of an example projectile engagement scenario which undergoes NUC in accordance with an illustrative embodiment of the present invention.

FIG. 4 illustrates an example projectile engagement scenario 400 where the projectile utilizes the real-time, in situ NUC corresponding to the temperature of the illuminating scene.

Figure 5A:
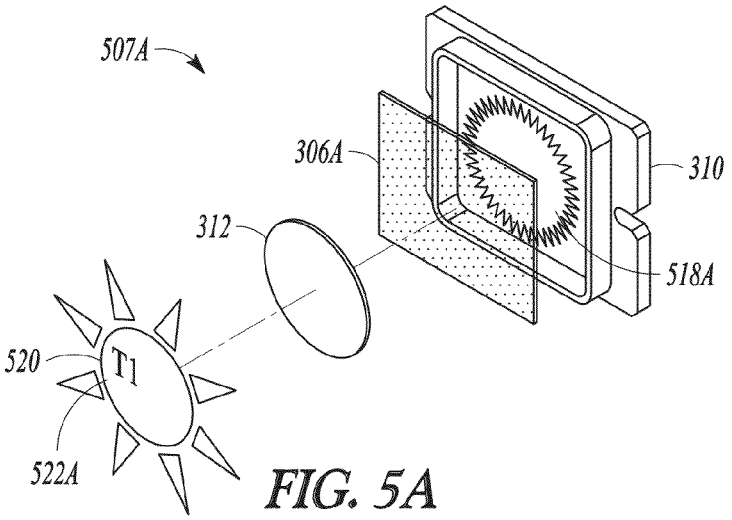
FIG. 5A is a simplified schematic of a deactivated IR modulator at a first intensity level, scattering the image in accordance with an illustrative embodiment of the present invention.
Figure 5B:
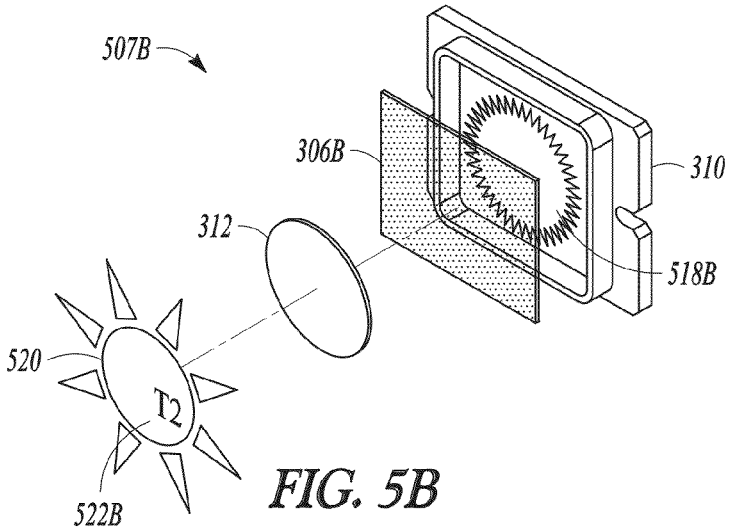
FIG. 5B is a simplified schematic of an activated IR modulator (with a voltage V1) at a second intensity level, scattering the image in accordance with an illustrative embodiment of the present invention.
Figure 5C:
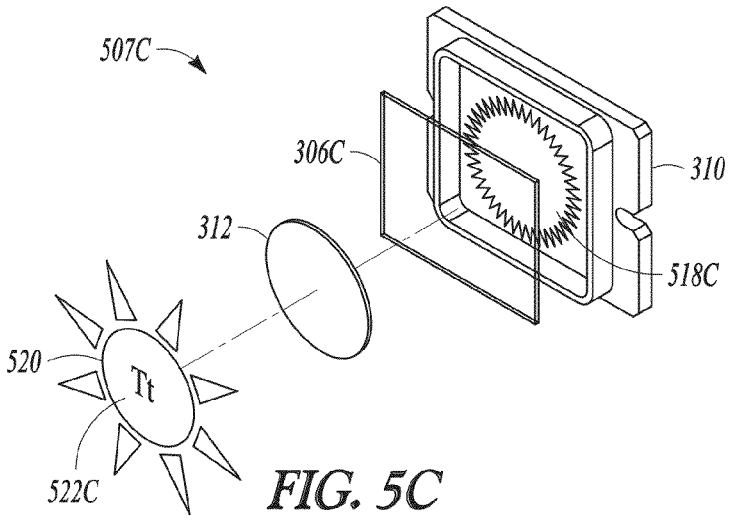
FIG. 5C is a simplified schematic of an activated IR modulator (with a voltage V2>V1) which is transparent in accordance with an illustrative embodiment of the present invention.

Operational steps of the IR modulator 306 positioned between the FPA 310 and the optical elements 312 are shown in FIGS. 5A-5C. The intensity of the image detected corresponds to an equivalent temperature of the scene. FIG. 5A shows the IR modulator 306 in an initial first "off" state 507A and scattering a transmission 518A at a first intensity level from a thermal target 520 having a first equivalent temperature (T1) 522A. FIG. 5B shows the IR modulator 306 in a second "on" state 507B and scattering a transmission 518B at a second intensity level from a thermal target 520 at a second equivalent temperature (T1) 522B. FIG. 5C shows the IR modulator 306 in a third state 507C (off) of clear transmission 518C of the wave front of a thermal target 520 with a target temperature (Tt) 522C. IR modulators 306 which can "switch" from one state to another quickly are particularly useful in short mission scenarios, i.e., missions where time allotted for ADNUC is on the order of seconds or less. In one embodiment, activation of the IR modulator 306 is achieved over a speed no greater than 150 ms, during which the IR modulator 306 transitions from "off" to "on." In one embodiment, transitioning to a second "on" state requires up to an additional 150 msec. In one embodiment, deactivation of the IR modulator 306 is achieved at a speed no greater than 900 ms, during which the IR modulator 306 transitions from "on" to "off." In other embodiments, there are more than two "on" states.

Figure 6A:
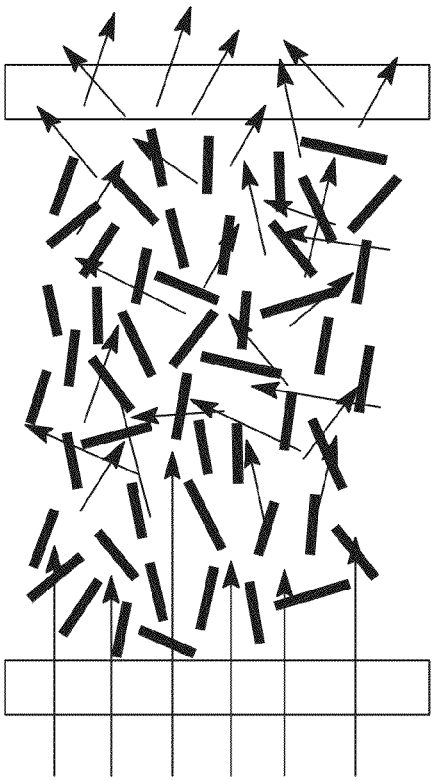
FIG. 6A is a simplified schematic of a nematic liquid crystal in an "off" state.

Various types of smart glass can be used in the IR modulators described herein. In one embodiment a mesomorphic material, such as a liquid crystal (LC) is used, which can change between a liquid and a crystal. LC molecular species have many phases of formation, including the nematic (i.e., threadlike) phase. As shown in FIG. 6A, under ambient thermal conditions, the molecules in a nematic LC are distributed in random orientations, thus behaving more like a fluid. The random distribution causes scattering of light. With the application of a voltage, to an "on" state, LC molecules begin to align to the applied electric field (E), increasing the intensity of scattered light.

Figure 6B:
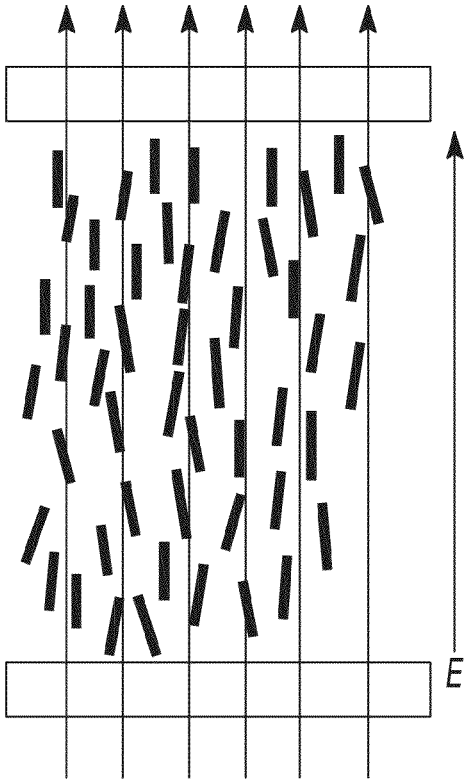
FIG. 6B is a simplified schematic of a nematic liquid crystal in an "on" state with an applied electric field (E).

Upon application of an electric field (E), such as in FIG. 6B, the dipole moment of each molecule becomes homeotropically aligned to the field, thus forming a crystalline state and allowing a degree of transparency of incident light through the material. Essentially, when in an "off" state, an IR modulator provides a substantially attenuated scene. An "off" state is a highly scattered, nearly opaque state which allows only a low level of intensity in which a T1 measurement can be obtained. The first "on" state is still a scattered state, but allows a higher level of intensity in which a T2 measurement can be obtained. The second "on" state is a transparent state where the effective temperature becomes the detected temperature of the target. In one embodiment, the second "on" state is an intermediate (non-scattered) state, which provides less clear transparency where the effective temperature is the actual target temperature of the target. (See, for example FIG. 12, where final "on" state with highest applied voltage has the clearest transmission). Additionally, the smectic phase of a LC exhibits a stratified order of the molecules in the direction perpendicular to the alignment. Thus, in one embodiment, the IR modulator produces a diffuse scene that can be associated with an effective temperature.

The occurrence of birefringence is a feature of liquid crystals in general, and is exploited in displays with polarizers attached to the substrates, forming character shapes commonly seen in liquid crystal displays. The difference between the indices of refraction of the two polarization states of the transmitted light is the measure of birefringence, $\Delta n$.

Various types of IR scattering materials can be used herein, including, but not limited to, any type of metal oxide which is thermochromic, electrochromic or both. In one embodiment, metal oxides, using metals such as vanadium, tungsten, nickel, and indium may be used. It is possible other materials or combinations of materials can be used, as long as they possess the desired features as described herein. In one embodiment, vanadium oxide is used. Vanadium oxide can provide a reflection to transmission state from about 10% to about 80% for switching speeds from about two (2) milliseconds (ms) up to about 0.5 ms. (See, for example, U.S. Pat. No. 4,283,113 to Eden).

Figure 7:
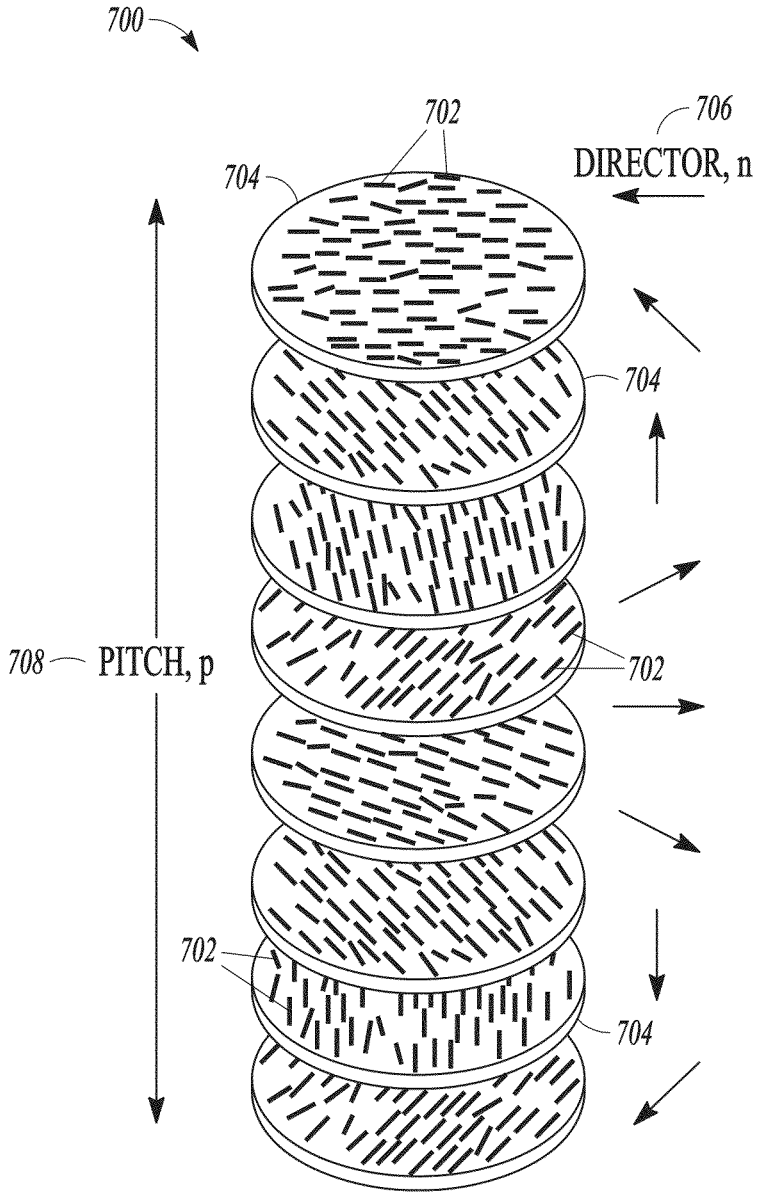
FIG. 7 is a simplified schematic of a cholesteric liquid crystal (CLC) structure showing stacked layers of nematic LC planes with a chiral helix structure, reflecting a selected waveband.

In one embodiment, a cholestric liquid crystal (CLC) 700, as shown in FIG. 7 is used. The CLC 700 is composed of chiral molecules 702, with a helical twisting of nematic planes 704 stacked vertically. The direction of the average dipole alignment vector of the sample is defined as the director, "n", 706 of the liquid crystal. Therefore, the plate $2\pi$ rotation of "n" 706 of each nematic plane 704 constitutes the pitch, "P" 708.

In one embodiment, the nematic host is a mixture containing cyano biphenyls and cyano terphenyls with lateral fluoro substitutions with the amount of rotation per unit length defined as the rotary power (P), with P=1/(helical twisting power)×(concentration of the chiral dopant).

Figure 8:
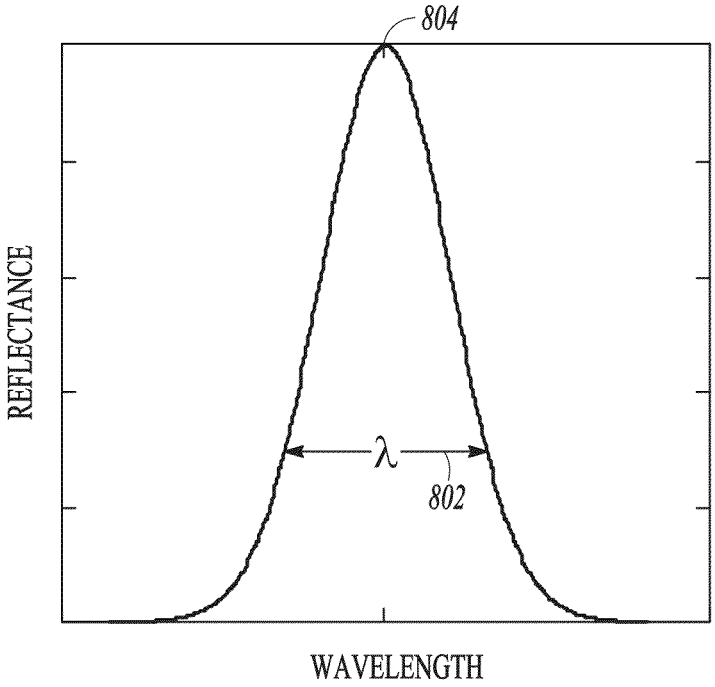
FIG. 8 is a graph of reflectance versus wavelength of an IR modulator with the stacked structured of CLC in the "off" state.

A CLC has selective Bragg reflection because of its periodic helical structure when confined in a homogeneous cell. As such, and as shown in FIG. 8, distribution of reflected light 802, as well as the central peak 804 can be tuned with a variation of the birefringence of the liquid crystal as determined by the spacing of the stacked planes.

The wavelength reflected is determined by the average refractive index, <n>, of the CLC and the cholesteric pitch length, P. The chirality of a CLC limits reflection to one circular polarization (left or right handed). In one embodiment, two cells having substantially the same pitch, but opposite handedness, can be stacked in order to achieve polarization independence. In one embodiment, as described in Example 1, the NUC is accomplished through polarization neutral transmission of long wave infrared (LWIR) radiation through a liquid crystal (LC) device using a pair of cholesteric right and left handed LC molecules (CLC).

Figure 9A:
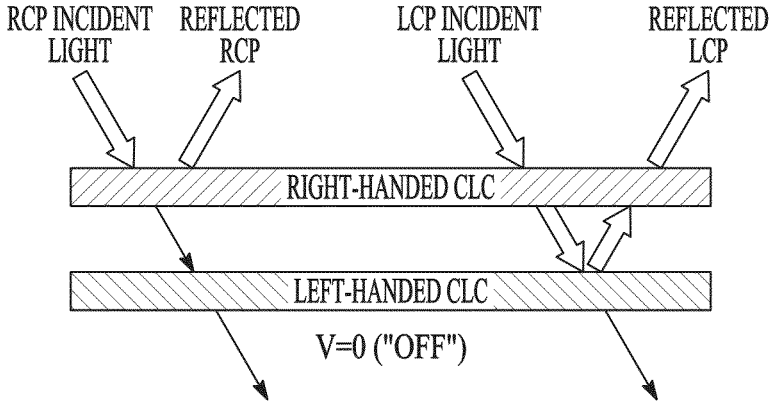
FIG. 9A is a simplified schematic of a two cell (left and right handed CLC) IR modulator in an "off" state reflecting incident light in accordance with an illustrative embodiment of the present invention.
Figure 9B:
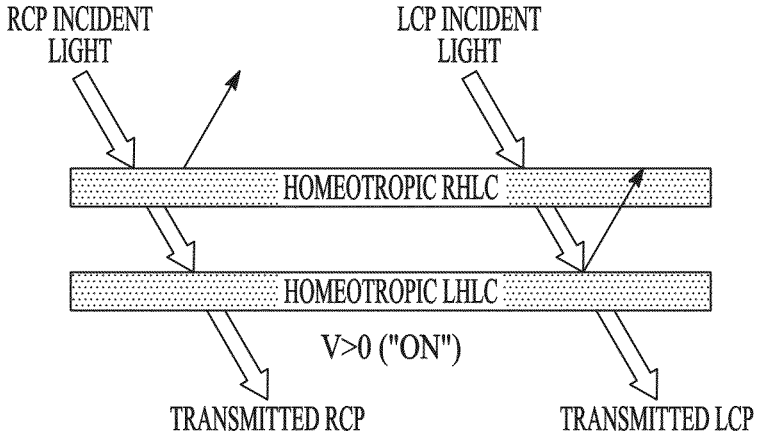
FIG. 9B is a simplified schematic of the same IR modulator in an "on" state transmitting incident light in accordance with an illustrative embodiment of the present invention.

The two-stacked CLC cell concept is shown in FIGS. 9A and 9B. The duel stack of left-handed and right-handed CLC produces a polarization neutral transmission. Polarization independence in IR sensor applications is important for maintaining fidelity of spatial resolution, maximum IR signal and eliminating undesired polarization characteristics of the imaged scene. In this embodiment, the IR modulator 900 comprises two CLC cells, having both right handed and left handed circular polarization. FIG. 9A shows the "off" state without an applied voltage, reflecting the incident light. FIG. 9B shows the "on state", with an applied voltage, such that both cells transmit IR with minimal loss due to absorption. The resulting device is polarization independent.

The optical rotation rate per unit thickness of material, or rotary power, $\rho$, can be calculated according to the following formula:

$$\rho = \frac{-\pi P(\Delta n)^2}{4\lambda^2} \rightarrow \mu\text{rad}/\mu$$

In the testing performed, this was calculated to be −2.8 μrad/μ. Variation in the residual birefringence between the left and right handed CLCs is expected to produce a measureable rotary power, comparable to theory, relevant for the resulting image quality.

In one embodiment, suspended particle devices (SPDs) are used. A SPD incorporates the alignment of microscopic charged particles suspended in a fluid which align from a random state to an ordered state under an applied electric field (similar to FIG. 6B). For SPDs operating in the visible, variable states of scattering or tint can be achieved, but transition times are slow, on the order of seconds.

Embodiments of the invention will be further described by reference to the following examples, which are offered to further illustrate various embodiments of the present invention. It should be understood, however, that many variations and modifications may be made while remaining within the scope of the present invention.

EXAMPLE 1

The CLC mixture for the LWIR demonstration was a Merck Liquid Crystals (MLC 7247 and MLC 6248) comprising a nematic host and a 1.67 wt % chiral dopant(s). The two CLC mixtures were formulated, with one left-handed and the other right-handed. The pitch of the chiral mixtures was approximately six (6) microns. Stacking of two cells with the same pitch, but opposite handedness was used to achieve polarization independence as shown in FIGS. 9A and 9B.

Figure 10:
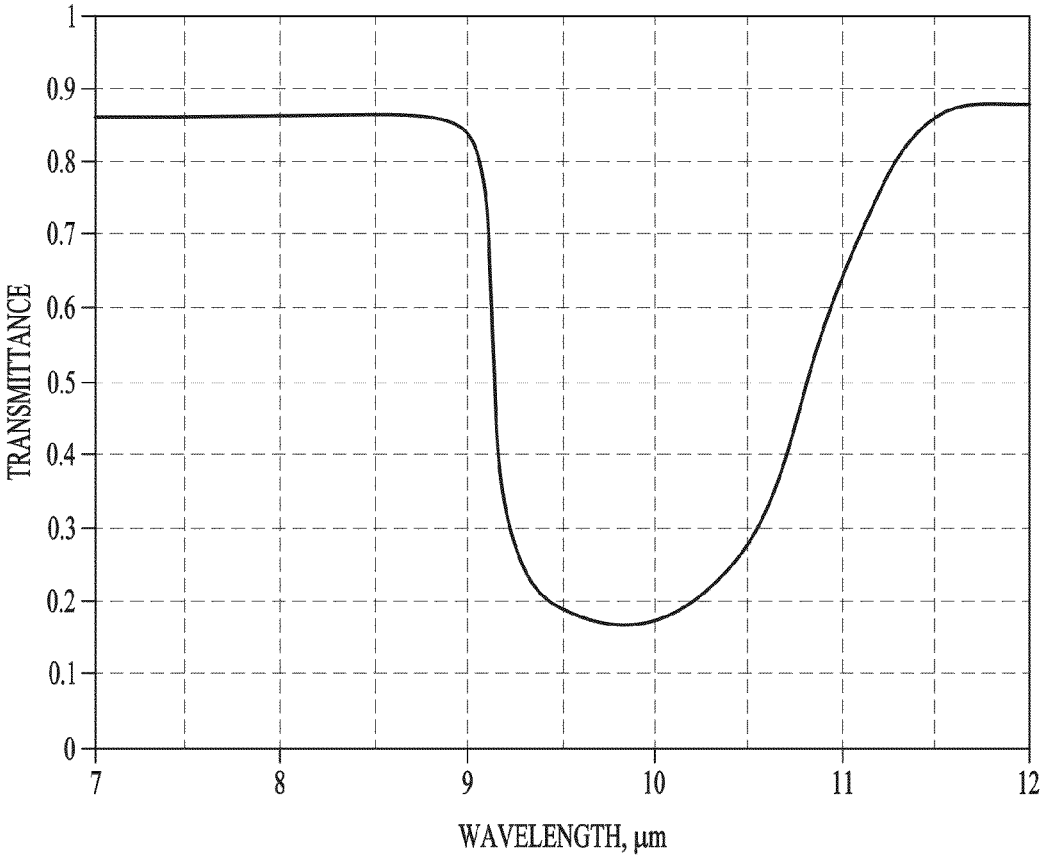
FIG. 10 shows conceptual spectral transmission with a two cell CLC design in accordance with an illustrative embodiment of the present invention.

FIG. 10 shows conceptual behavior anticipated with a CLC two cell design. Theoretically, the amount of transmission increases with a larger gap size between the substrates. The targeted range of such a transmission would be between 8 and 12 microns. The simulation further assumes that the IR modulator would be "off" with no applied voltage, which would allow light to be reflected from the surfaces. In the "on" state both cells are assumed to transmit IR with minimal absorption.

Prototype Build and Test

The prototype parts were fabricated using "in house" components and commercially available Ge substrates purchased from Mellos Griot. The final assembled component was an IR modulator, which was roughly the size of an American dime, although thicker, and substantially square in shape.

Fabrication also involved surface preparation of the Ge substrates for polyimide deposition. Specifically, about 0.5 grams of right handed and left handed CLC was deposited between the two pairs of prepared substrates. The gaps, constrained by glass shims, were approximately 22 μm and sealed by UV cured epoxy.

Figure 11:
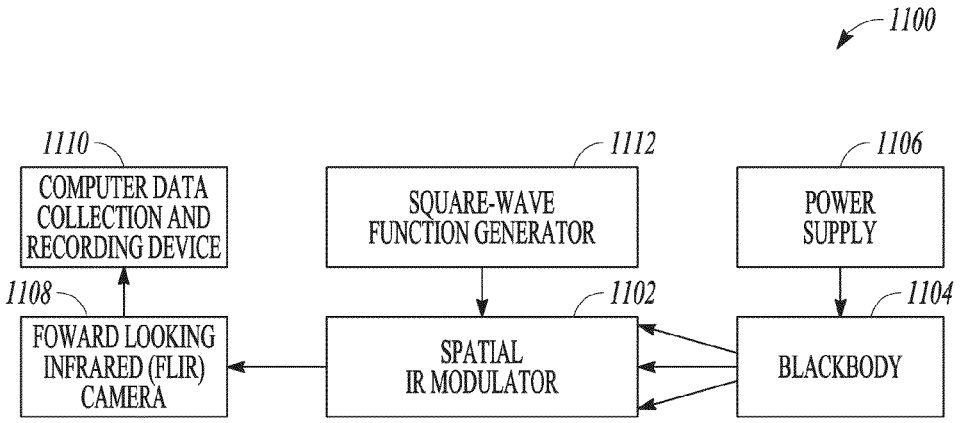
FIG. 11 is a simplified schematic of a test set-up in accordance with an illustrative embodiment of the present invention.

Thermal IR data was collected with a Holraum test set-up as shown in FIG. 11. The set-up 1110 included a light, i.e., a blackbody 1104 having a power source 1106. The blackbody 1104 was used for IR back illumination to back illuminate the IR spatial modulator 1102 while operating in "on" and "off" modes. The blackbody 1104 was set to 310 K (37° C.). Both the apparent temperature of the source imaged through the IR spatial modulator 1102 and the switching speed of the IR spatial modulator 1102 from "on" to "off" were measured. Temperature transmission was measured with a FLIR camera 1108 connected to a computer data collection and recording device 1110 which recorded images and video of the IR spatial modulator 1102 during operation. The IR spatial modulator 1102 was activated by applying a potential voltage across the Ge substrates of each cell driven by a square-wave function generator 1112. (See FIG. 13).

Additional testing measuring the spectral transmission of the IR spatial modulator 1102 shown in FIG. 11 with a Bruker Equinox 55 Fourier Transform IR (FTIR) spectrometer (not shown) was also performed. (As is known in the art, an FTIR Spectrometer is a box containing a coherent light source which splits light into specific wavelengths). As such, light from the coherent light source in the FTIR spectrometer was reflected by multiple mirrors configured in a known manner within the FTIR spectrometer, then passed through the IR spatial modulator 1102 shown in FIG. 11 to a detector portion of the FTIR spectrometer, with the resulting information input into the computer data collection and recording device 1110. Modulation of the applied voltage from the square-wave function generator 1112 was also input into the IR spatial modulator 1102 in order to measure the spectral transmission of the IR spatial modulator 1102, which is plotted in FIG. 12 discussed below. See for example, the image showing a light path through a comparable Michelson interferometer at http://en.wikipedia.org/wiki/Interferometry, which image is incorporated herein by reference.

Results

Spectral Transmission

Figure 12:
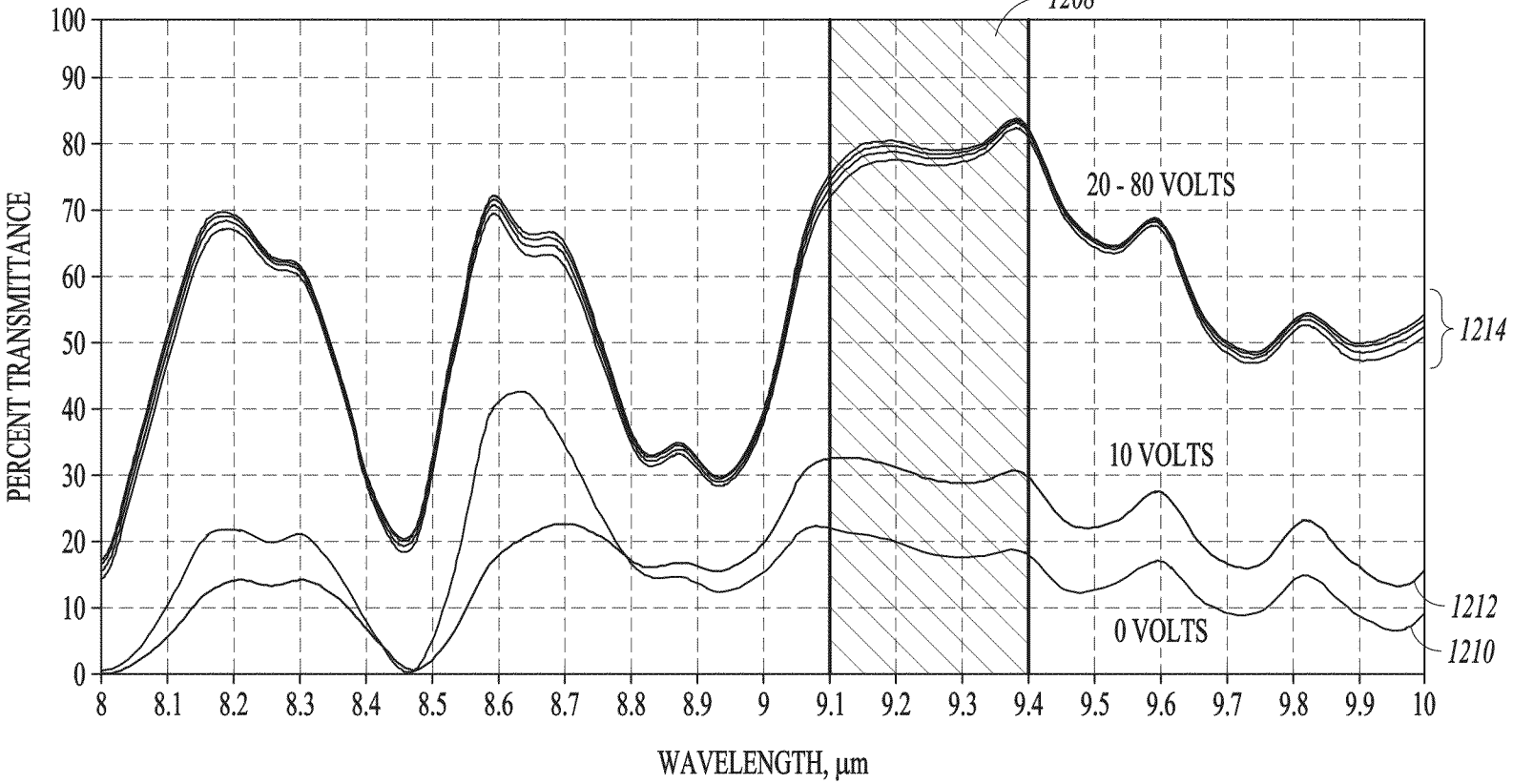
FIG. 12 is a transmission spectrum of an IR modulator at various voltages using a germanium (Ge) substrate in accordance with an illustrative embodiment of the present invention.

Preliminary proof of concept testing was performed using a ZnSe substrate. Thereafter the Ge substrate described herein was used. FIG. 12 shows the spectral transmission performance of the IR spatial modulator 1102 of FIG. 11 (as measured with the FTIR spectrometer (not shown) from eight (8) to ten (10) microns using the Ge substrate 1214. Transmission occurs for an applied potential of ≥20 V RMS, which was driven at 1 kHz with a square wave pulse. The most dramatic spectral range demonstrating the action of the IR spatial modulator 1102 is highlighted in a LWIR target region 1208, located between 9.1-9.4 μm. In the LWIR target region 1208, light was blocked with no voltage applied (reflective state) 1210. The change in transmission seen in FIG. 12 from an "on" 20V to a reflective "off state (0V) was approximately 60%. An intermediate transmission state of 30% occurred at 10V 1212.

It is known that the birefringence, Δn, of the IR spatial modulator 1102 is 0.24 in the LWIR at room temperature (using MLC 7247 and 6248). The pitch, P, of the cholesteric mixture is approximately six (6) μm, with the band pass calculated to be 1.44 μm using the following equation: $\Delta\lambda=\Delta n \cdot P$. With detailed information of the electro-optic behavior of the LC in combination with the substrate absorption characteristics, modeling of the transmission spectrum can be derived for comparison with measured results in FIG. 10. Characterizing secondary reflections from the Bragg cells and/or poly crystalline formations of the LC materials can contribute to higher fidelity predictions from a derived model.

Switching Speed and Effective Temperature

Referring again to FIG. 11, the potential temperature performance the blackbody 1104 was imaged by the FLIR camera 1108 operating at a 60 Hz frame rate. Switching from a reflective "off" state to the transparent "on" state was preformed with a 0 to 80 V applied potential operated at one (1) kHz. The electrical turn-on & turn-off transients were not controlled.

Figure 13:
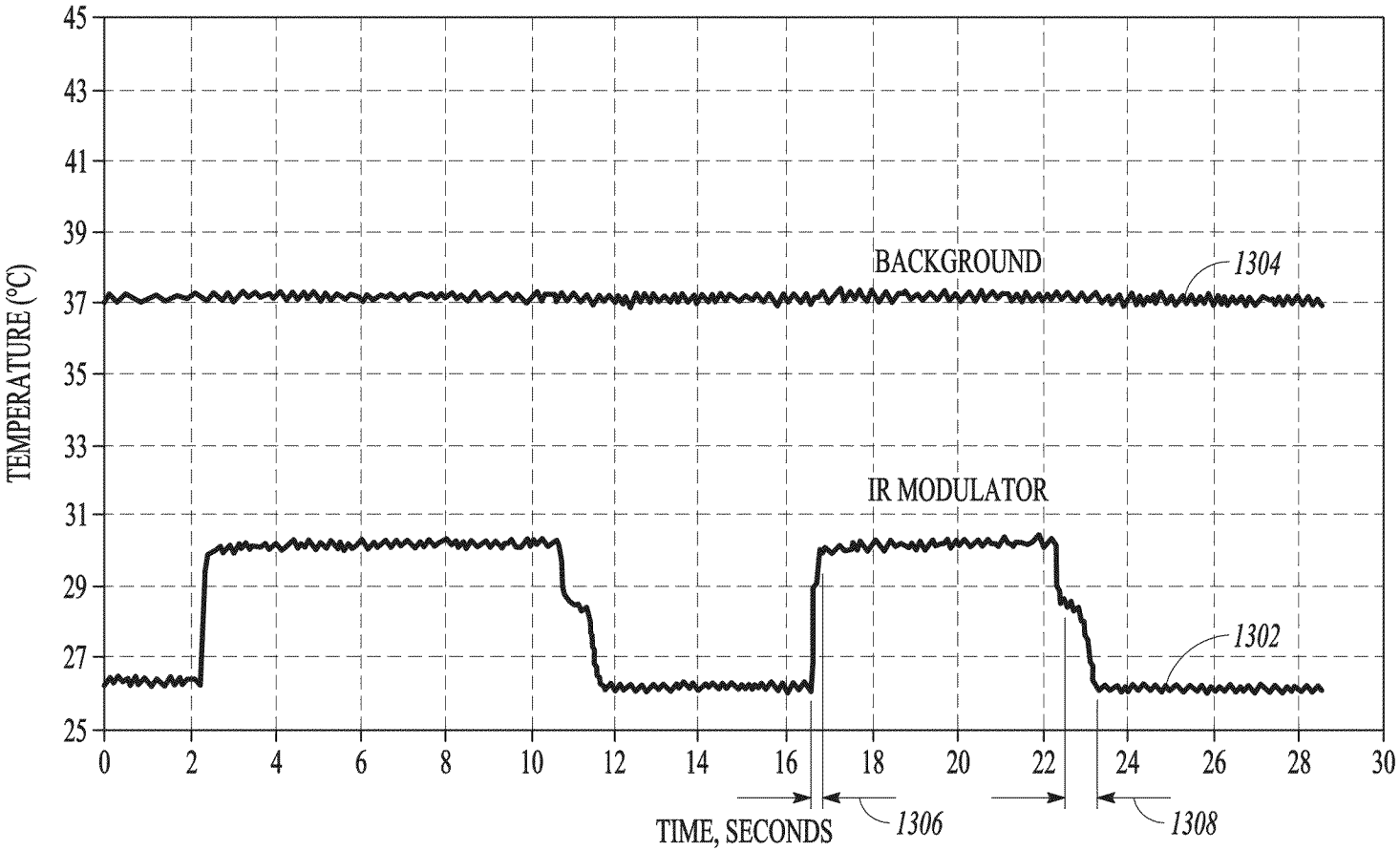
FIG. 13 shows radiometric performance of an IR modulator in both the activate "on" transmission state and in the "off" scattering state as measured using a blackbody source set to 37° C. as background in accordance with an illustrative embodiment of the present invention.

The radiometric transmission performance of the IR spatial modulator 1102 was measured using the blackbody 1104 set to 37° C. in the Holraum test-setup as shown in FIG. 11. FIG. 13 shows the apparent, or "equivalent" temperature transmitted through the (Ge-based) IR modulator 1102 to range from 30° C. to 26° C. between the "on" (transmission) and "off" (reflective) states. (This is in comparison to a conventional laboratory ΔT of 10° C. for a reference-based, pre-calibration method).

The effective temperature imaged was measured in both the "on" and "off" states. A 4° C. difference in transmitted temperature was measured with transition times between states of under one second. (See FIG. 13). The effective temperature of an image generated by the (Ge-based) IR modulator 1102 is also plotted in FIG. 13 to show the switching speed of the device. Activation 1306 of the IR modulator 1102 was achieved over a 150 ms "on" transition. Deactivation 1308 of the IR modulator 1102 required a slower "off" transition period, of 900 milliseconds (ms). The relative contribution of LC intrinsic relaxation phenomena and the uncontrolled voltage transient performance of the switching electronics likely contributed to the longer turn off transition time.

LWIR Video Images

Figure 14A:
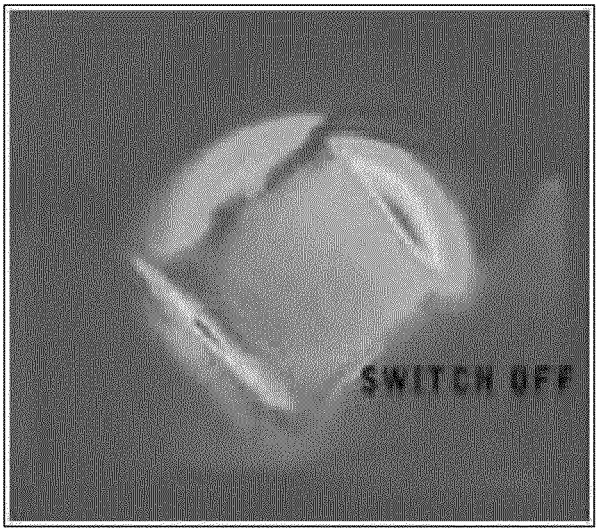
FIG. 14A is a false color long wave IR image of an IR modulator in operation with the 37° C. blackbody background showing a blocking transmission in an "off" state in accordance with an illustrative embodiment of the present invention.
Figure 14B:
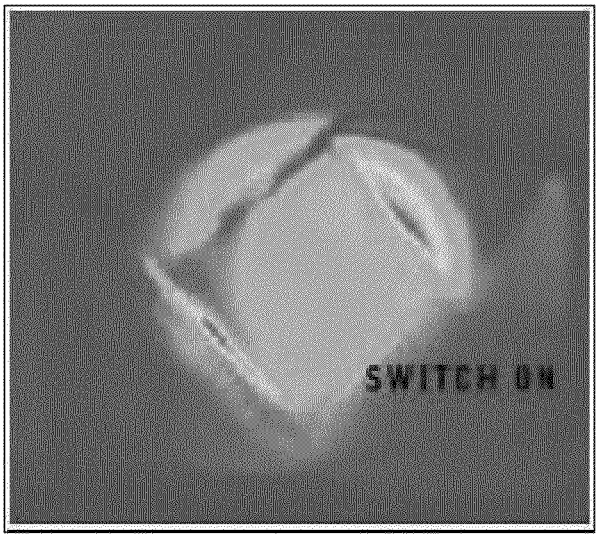
FIG. 14B is a false color long wave IR image of an IR modulator in operation with the 37° C. blackbody background showing polarization neutral long wave infrared (LWIR) transmission in the "on" state in accordance with an illustrative embodiment of the present invention.

Using the FLIR camera 1108 operating at 60 Hz, transmission of the (Ge-based) IR modulator 1102 was recorded switching between "on" and "off" states while backlit with the blackbody 1104 set at 37° C. FIGS. 14A and 14B show the radiometric transmission performance at different points in time. Specifically, FIG. 14A shows the Ge-based IR modulator 1102 in operation with the 37° C. blackbody background showing a blocking transmission in an "off" state. FIG. 14B shows the Ge-based IR modulator 1102 in operation with the 37° C. blackbody background showing a polarization neutral long wave infrared (LWIR) transmission in the "on" state. In between these times is a blocking transmission in which the IR modulator 1102 is transitioning to an "on" state.

Thus, the ability of the system to produce a diffuse scene that can be associated with an effective temperature has been demonstrated.

EXAMPLE 2

Prophetic

The image quality (i.e., Modulation Transfer Function (MTF))) in the LWIR transmitted through the device in operation will be measured.

EXAMPLE 3

Prophetic

The degree of scattering (or reflection) achieved in the "off" or intermediate (10 to 20 V) states will be measured.

EXAMPLE 4

Prophetic

Thermal behavior of the IR modulator over typical operational temperatures will also be determined, i.e. (LC response to applied voltage varies with temperature, and with eventual phase changes at critical temperatures such that no applied voltage can alter the state.

EXAMPLE 5

Prophetic

The degree of polarization neutrality, i.e., amount of residual birefringence for image quality in the transparent state will also be measured.

Figure 15:
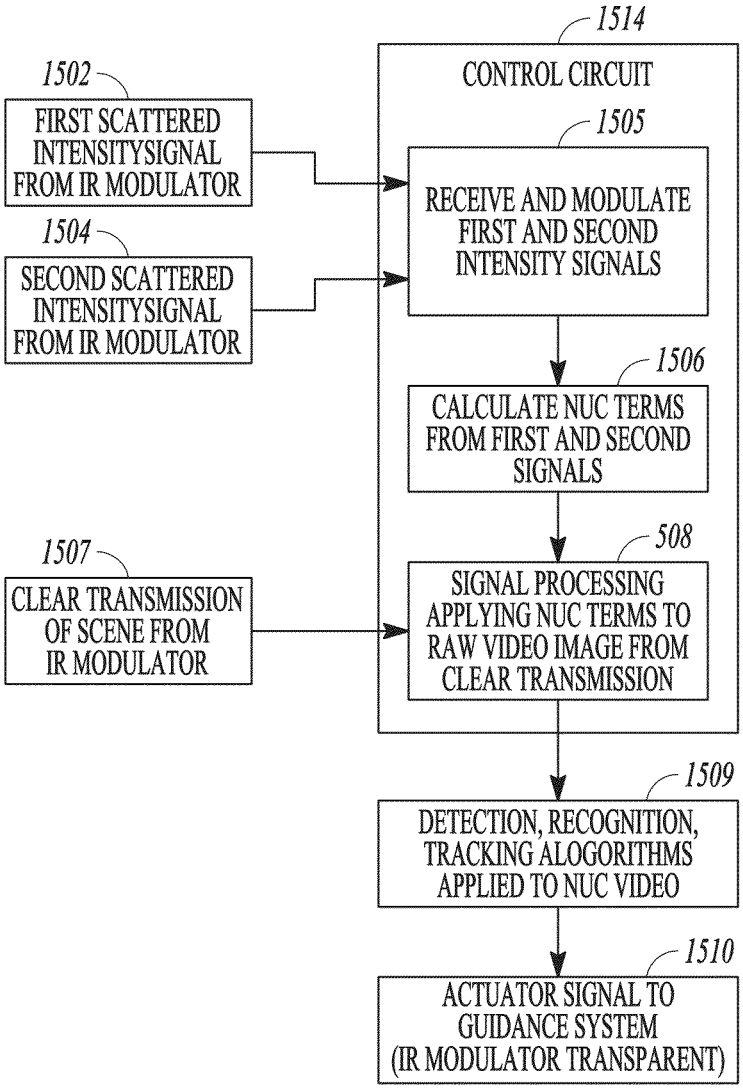
FIG. 15 is a block flow diagram illustrating signal level features for performing NUC in accordance with an illustrative embodiment of the present invention.

Embodiments may be implemented in one or a combination of hardware, firmware and software. In these embodiments, as shown in FIG. 15, the control circuit 1514 and portions of the IR modulator which provide a first intensity signal 1502 and a second intensity signal 1504 may be configured to implement instructions stored on a computer-readable storage device, which may be read and executed by at least one processor to perform the operations described herein. A computer-readable storage device may include any non-transitory mechanism for storing information in a form readable by a machine (e.g., a computer). For example, a computer-readable storage device may include read-only memory (ROM), random-access memory (RAM), magnetic disk storage media, optical storage media, flash-memory devices, and other storage devices and media. The control circuit 1504 and the IR modulator may include one or more processors and may be configured with instructions stored on a computer-readable storage device. In the embodiment shown in FIG. 15, the control circuit 1514 receives and the first and second intensity signals 1505 from the IR modulator to produce NUC terms 1506 applied to 1508 clear transmission images 1507. Signal processing 1508 is then performed using the corrected image. This can include detection, recognition and tracking with algorithms. A resulting actuator signal is then provided 1510 to the guidance system while the IR modulator is activated to become transparent (allowing the projectile on which the IR modulator is located to adjust the flight path accordingly, so that the desired target is hit).

Figure 16:
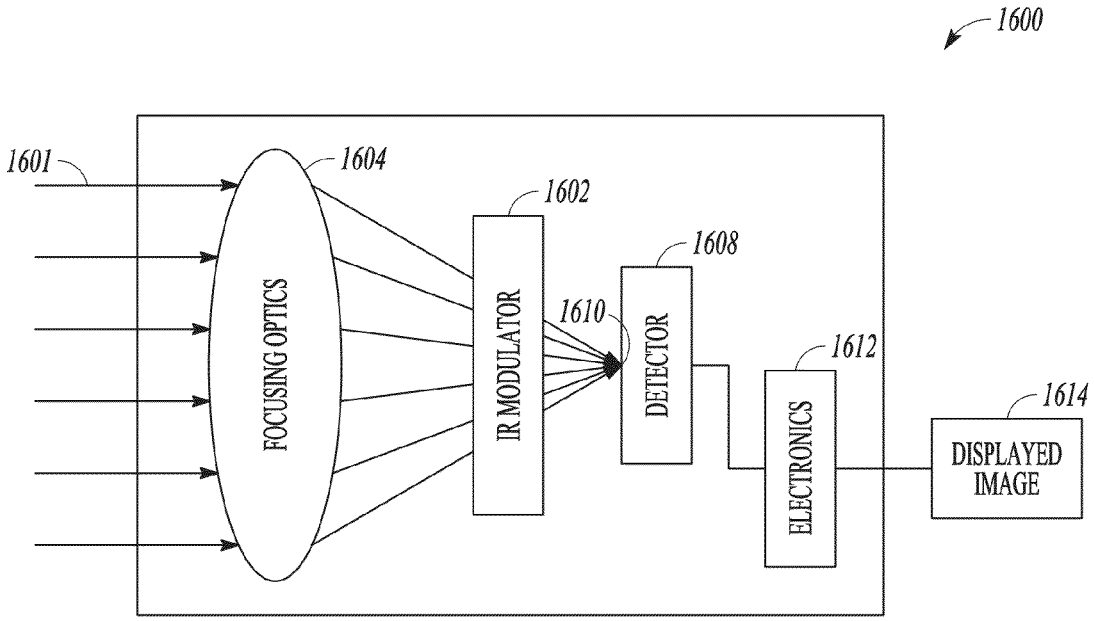
FIG. 16 is a simplified schematic of an IR sensor containing an IR modulator in accordance with an alternative illustrative embodiment of the present invention.

In an alternative embodiment as shown in FIG. 16, an IR modulator 1602 is used in a camera to receive and modulate light waves 1601 through imaging optics 1604 (e.g., a reflective telescope or a lens) and transmit modulated light waves 1601 to a detector 1608, which itself is connected to electronics 1612, in order to produce a displayed image 1614 useful in a variety of applications other than on heat-seekers, such as various other military as well as civilian or medical applications. Example include, but are not limited to, use in vehicles having bolometers, in fire-fighting imagers or any type of diagnostic imager used to detect heat, such as in energy efficiency building analysis.

In the various embodiments described herein the target is a blackbody viewed radiometrically and the IR associated with the blackbody has a temperature associated with it. By changing the amount of LWIR radiation that goes through an IR modulator, a different effective temperature is obtained, thus allowing for the NUC correction.

Additional benefits of this technology include the ability to shield un-cooled LWIR FPAs from thermal damage due to exposure of direct sunlight or intense radiation. The novel embodiments described herein also have application to short wave IR (SWIR) and mid wave IR (MWIR) bands, dynamic spectral filters throughout the IR spectrum, focal plane noise filtering by simulating a "chopped" IR signal using the dynamic shuttering capability, and possible applications to computational optics.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A system for navigating an object having a flight path comprising:

an infrared sensor having an optical path;

an infrared modulator in the optical path of the infrared sensor, wherein the infrared modulator is configured to allow the infrared sensor to perform in situ, scene-based non-uniformity correction, and wherein the infrared modulator comprises smart glass configured to have a first state during which a first temperature measurement is obtained by the infrared sensor, a second state during which a second temperature measurement is obtained by the infrared sensor, and a third state during which a target temperature measurement is obtained by the infrared sensor; and a guidance system within the object, wherein the guidance system can adjust the flight path of the object based on the non-uniformity correction.

2. The system of claim 1 wherein the infrared sensor is a long wave infrared uncooled sensor.

3. The system of claim 1 wherein the infrared modulator is configured to transmit translucent scattered infrared signals to the infrared sensor when activated by infrared signals.

4. The system of claim 1 wherein the infrared modulator transmits at least two translucent infrared signals of different intensities to the infrared sensor.

5. The system of claim 4 wherein the infrared modulator becomes transparent when activated.

6. The system of claim 5 wherein the guidance system further comprises:

a control circuit connected to the infrared modulator and the infrared sensor, the control system configured to receive and modulate the at least two translucent infrared signals to produce a corrected image;

perform signal processing using the corrected image; and provide an actuator signal to the guidance system wherein the flight path of the object is adjusted.

7. The system of claim 1 wherein the smart glass is a mesomorphic material or a suspended particle device.

8. The system of claim 7 wherein the mesomorphic material is a liquid crystal.

9. A method for navigating an object comprising:

providing an infrared sensor having an optical path;

with an infrared modulator in the optical path of the infrared sensor, allowing the infrared sensor to perform, in situ, scene-based non-uniformity correction of a scene, and wherein the infrared modulator comprises smart glass configured to have a first state during which a first temperature measurement is obtained by the infrared sensor, a second state during which a second temperature measurement is obtained by the infrared sensor, and a third state during which a target temperature measurement is obtained by the infrared sensor; and adjusting a flight path of the object based on the non-uniformity correction.

10. The method of claim 9 wherein translucent scattered images of the scene are processed in the infrared sensor to produce intensity signals containing information useful for calculating non-uniform correction terms.

11. The method of claim 10 wherein a transparent image of the scene is processed in the infrared sensor to produce a scene intensity signal containing information which, in combination with the non-uniform correction terms, provides a spatially corrected uniform image.

12. A method of navigating an object comprising:

with an onboard spatial infrared modulator that is in an optical path between an infrared sensor and an optical element, applying a non-uniform correction to the infrared sensor, the non-uniform correction comprising:

with a video device, obtaining a first video image of a first translucent scattered image of a scene having a target equivalent temperature, the scene containing a target blackbody object, a first equivalent blackbody object, and a second equivalent blackbody object, wherein the first equivalent blackbody object has a first intensity associated with a first equivalent temperature that is obtained by the infrared sensor through the infrared modulator when the infrared modulator is in a first state;

processing the first video image in the infrared sensor, wherein the infrared sensor provides a first intensity signal to a calculating device;

obtaining a second video image of a second translucent scattered image of the scene, wherein the second equivalent blackbody object has a second intensity associated with a second equivalent temperature that is obtained by the infrared sensor through the infrared modulator when the infrared modulator is in a second state that is more clear than the first state;

processing the second video image in the infrared sensor, wherein the infrared sensor provides a second intensity signal to the calculating device;

calculating non-uniform correction terms from information in the first and second intensity signals;

with the infrared modulator operating in a transparent state, obtaining a third video image of the target blackbody object, the target blackbody object having a target blackbody intensity associated with the target equivalent temperature that is obtained by the infrared sensor through the infrared modulator when the infrared modulator is in a third state that is more clear than the first or second states;

processing the third video image in the infrared sensor, wherein the infrared sensor provides a scene intensity signal to the calculating device; and performing signal processing using the scene intensity signal and the non-uniform correction terms to produce a spatially corrected uniform image.

13. The method of claim 12 further comprising:

activating the onboard infrared modulator, wherein the onboard infrared modulator becomes transparent; and providing an actuator signal to a guidance system in communication with the onboard infrared modulator.

14. The method of claim 12 wherein the infrared sensor is a focal plane array.

15. The method of claim 12 wherein the infrared modulator can switch from transmitting the second translucent scattered image to transmitting the subsequent transparent image in less than one (1) second.

16. The method of claim 12 wherein the infrared modulator can switch in 150 ms or less.

17. The method of claim 12 wherein the method further comprises transmitting an initial transparent image prior to transmitting the first translucent image, and the infrared modulator can switch from transmitting the initial transparent image to transmitting the first translucent image in 900 ms or less.

18. The method of claim 12 wherein the first, second and target equivalent temperatures comprise a scene effective temperature and the scene effective temperature ranges from 0° C. to about 50° C.

19. The method of claim 18 wherein the non-uniformity correction is performed at effective temperatures of between about 20° C. and about 30° C., such that calibration is provided over the entire scene effective temperature range.

20. A guided projectile comprising:

a housing;

an infrared modulator within the housing, wherein the infrared modulator is located between an infrared sensor and an infrared optical element, wherein the infrared modulator is configured to allow the infrared sensor to perform in situ scene-based non-uniformity correction, and wherein the infrared modulator comprises smart glass configured to have a first state during which a first temperature measurement is obtained by the infrared sensor, a second state during which a second temperature measurement is obtained by the infrared sensor, and a third state during which a target temperature measurement is obtained by the infrared sensor; and a guidance system within the casing, wherein the guidance system navigates the guided projectile based on the non-uniformity correction.

21. The guided projectile of claim 20 wherein the infrared optical element is an IR lens or a reflecting telescope.

22. The guided projectile of claim 20 wherein the infrared modulator becomes transparent when activated.

23. An infrared modulator comprising:

a non-uniform correction infrared (IR) spatial modulator located in an optical path of an IR sensor, wherein the IR spatial modulator is capable of transmitting and scattering variable intensities of IR radiation from a target imaged to the focal plane array (FPA) of a thermal IR sensor; wherein the spatial modulator comprises smart glass configured to have a first state during which a first temperature measurement is obtained by the infrared sensor, a second state during which a second temperature measurement is obtained by the infrared sensor, and a third state during which a target temperature measurement is obtained by the infrared sensor.

24. The infrared modulator of claim 23 wherein activation and deactivation of the IR modulator allows scene-based non-uniform correction to be performed.

25. The infrared modulator of claim 23 wherein the non-uniform correction can be applied in less than one second.

26. The infrared modulator of claim 23 comprising a liquid crystal device or a suspended particle device.

* * * * *

UNITED STATES PATENT AND TRADEMARK OFFICE

CERTIFICATE OF CORRECTION

PATENT NO. : 8,872,111 B2
APPLICATION NO. : 13/020941
DATED : October 28, 2014
INVENTOR(S) : Michael K. Burkland It is certified that error appears in the above-identified patent and that said Letters Patent is hereby corrected as shown below:

In the drawings,

Sheet 13 of 14, Fig. 15, reference numeral 508, delete "508" and insert --1508--, therefor In the specification, In column 5, line 19, delete "NEAT" and insert --NEΔT--, therefor In column 5, line 23, delete "NEAT" and insert --NEΔT--, therefor Signed and Sealed this
Thirty-first Day of May, 2016

Michelle K. Lee

Michelle K. Lee
*Director of the United States Patent and Trademark Office*